US011103919B2

(12) United States Patent
Yan et al.

(10) Patent No.: US 11,103,919 B2
(45) Date of Patent: Aug. 31, 2021

(54) 7XX ALUMINUM CASTING ALLOYS, AND METHODS FOR MAKING THE SAME

(71) Applicant: ALCOA USA CORP., Pittsburgh, PA (US)

(72) Inventors: Xinyan Yan, Murrysville, PA (US); Eider Simielli, Monroeville, PA (US); Jen C. Lin, Export, PA (US); Wenping Zhang, Murrysville, PA (US); James Daniel Bryant, Murrysville, PA (US)

(73) Assignee: ALCOA USA CORP., Pittsburgh, PA (US)

( * ) Notice: Subject to any disclaimer, the term of this patent is extended or adjusted under 35 U.S.C. 154(b) by 444 days.

(21) Appl. No.: 14/694,109

(22) Filed: Apr. 23, 2015

(65) Prior Publication Data

US 2015/0315680 A1 Nov. 5, 2015

Related U.S. Application Data

(60) Provisional application No. 61/986,249, filed on Apr. 30, 2014.

(51) Int. Cl.

| | |
|---|---|
| ***B22D 21/04*** | (2006.01) |
| ***C22C 21/10*** | (2006.01) |
| ***C22F 1/053*** | (2006.01) |

(52) U.S. Cl.

CPC ..... *B22D 21/04* (2013.01); *C22C 21/10* (2013.01); *C22F 1/053* (2013.01)

(58) Field of Classification Search

CPC ..... B22D 21/04; C22C 21/10; C22F 1/053

See application file for complete search history.

(56) References Cited

U.S. PATENT DOCUMENTS

| | | | | | |
|---|---|---|---|---|---|
| 2,823,994 | A | | 2/1958 | Rosenkranz et al. | 75/141 |
| 4,060,411 | A | | 11/1977 | Goto et al. | 75/138 |
| 4,169,728 | A | * | 10/1979 | Takeuchi | C22C 21/10 420/532 |
| 4,711,762 | A | * | 12/1987 | Vernam | C22C 21/10 148/415 |
| 4,863,528 | A | * | 9/1989 | Brown | C22F 1/053 148/695 |
| 5,846,347 | A | | 12/1998 | Tanaka et al. | 148/439 |
| 6,790,407 | B2 | | 9/2004 | Fridlyander et al. | 420/532 |
| 2005/0079376 | A1 | | 4/2005 | Benedictus et al. | 428/654 |
| 2005/0238528 | A1 | | 10/2005 | Lin et al. | 420/532 |
| 2006/0000094 | A1 | | 1/2006 | Garesch et al. | 29/894.353 |
| 2008/0066833 | A1 | * | 3/2008 | Lin | C22C 1/06 148/549 |
| 2008/0173377 | A1 | * | 7/2008 | Khosla | C22C 21/14 148/550 |
| 2011/0008202 | A1 | | 1/2011 | Fischer et al. | 420/532 |
| 2012/0261035 | A1 | | 10/2012 | Lin et al. | 148/549 |
| 2015/0247229 | A1 | | 9/2015 | Lin et al. | 148/549 |

FOREIGN PATENT DOCUMENTS

| | | | | |
|---|---|---|---|---|
| CN | 101698914 | | | 4/2010 |
| CN | 101698915 | | | 4/2010 |
| CN | 101698916 | | | 4/2010 |
| CN | 101705399 | | | 5/2010 |
| EP | 1378581 | | * | 7/2004 |
| GB | 1154013 | | | 6/1969 |
| JP | 48-007822 | | | 1/1973 |
| JP | 58-161747 | | | 9/1983 |
| JP | 58-213852 | | | 12/1983 |
| JP | 59-28555 | | | 2/1984 |
| JP | S61-238937 | A | | 10/1986 |
| JP | 62-142753 | | | 6/1987 |
| JP | 03-122246 | | | 5/1991 |
| JP | 03-122247 | | | 5/1991 |
| JP | H03-122244 | A | | 5/1991 |
| JP | H03-122245 | | | 5/1991 |
| JP | 05-043970 | | | 2/1993 |
| JP | H08-120386 | A | | 5/1996 |
| JP | 10-168536 | | | 6/1998 |
| JP | 2002-371333 | | | 12/2002 |
| WO | WO2012/095940 | | | 7/2012 |
| WO | WO2015/121635 | | | 8/2015 |

OTHER PUBLICATIONS

Yue, T.M. "Squeeze casting of high-strength aluminum wrought alloy AA7010." 1997. Journal of Materials processing technology. 66. p. 179-185. (Year: 1997).*

Aluminum Foundry Products, Metals Handbook Desk Edition, ASM International, 1998, p. 484-489 (Year: 1998).*

International Search Report and Written Opinion, dated Jul. 20, 2015, from corresponding, co-owned International Patent Application No. PCT/US2015/027224.

Registration Record Series Pink Sheets "Designations and Chemical Composition Limits for Aluminum Alloys in the Form of Castings and Ingots", revised Nov. 2009, supersedes Feb. 2008, pp. 1-12.

Registration Record Series Teal Sheets, *International Alloy Designations and Chemical Composition Limits for Wrought Aluminum and Wrought Aluminum Alloys*, The Aluminum Association, pp. 1-28, Feb. 2009.

First Chinese Office Action, dated Oct. 23, 2017, from related Chinese Patent Application No. 201580022922.5 (English translation).

ASM Specialty Handbook, Aluminum and Aluminum Alloys, Physical Metallurgy, p. 41, J. R. Davis, publisher, p. 41, 1993.

* cited by examiner

*Primary Examiner* — Nicholas A Wang

(74) *Attorney, Agent, or Firm* — Greenberg Traurig, LLP

(57) ABSTRACT

New 7xx aluminum casting alloys are disclosed. The aluminum casting alloys generally include from 3.0 to 8.0 wt. % Zn, from 1.0 to 3.0 wt. % Mg, where the wt. % Zn exceeds the wt. % Mg, from 0.35 to 1.0 wt. % Cu, where the wt. % Mg exceeds the wt. % Cu, from 0.05 to 0.30 wt. % V, from 0.01 to 1.0 wt. % of at least one secondary element (Mn, Cr, Zr, Ti, B, and combinations thereof), up to 0.50 wt. % Fe, and up to 0.25 wt. % Si, the balance being aluminum and other elements, wherein the aluminum casting alloy include not greater than 0.05 wt. % each of the other elements, and wherein the aluminum casting alloy includes not greater than 0.15 wt. % in total of the other elements.

19 Claims, No Drawings

7XX ALUMINUM CASTING ALLOYS, AND METHODS FOR MAKING THE SAME

CROSS-REFERENCE TO RELATED APPLICATIONS

This patent application claims benefit of priority of U.S. Provisional Patent Application No. 61/986,249, filed Apr. 30, 2014, entitled "IMPROVED 7XX ALUMINUM CASTING ALLOYS, AND METHODS FOR MAKING THE SAME", which is incorporated herein by reference in its entirety.

BACKGROUND

Aluminum alloys are useful in a variety of applications. However, improving one property of an aluminum alloy without degrading another property is elusive. For example, it is difficult to increase the strength of an aluminum casting alloy without affecting other properties such as castability, elongation or stress corrosion cracking See, for example, U. S. Patent Application Publication No. 2008/0066833.

SUMMARY OF THE DISCLOSURE

Broadly, the present patent application relates to improved 7xx aluminum casting alloys, and methods for producing the same. The new 7xx aluminum casting alloys may realize, for instance, an improved combination of at least two of strength, corrosion resistance, castability, and fatigue failure resistance, among other properties.

The new 7xx aluminum casting alloys generally comprise (and in some instance consist essentially of, or consist of), zinc (Zn), magnesium (Mg), copper (Cu), and vanadium (V) as primary alloying elements, and at least one secondary element selected from the group consisting of manganese (Mn), chromium (Cr), zirconium (Zr), titanium (Ti), and boron (B), the balance being aluminum (Al), iron (Fe), silicon (Si), and other elements, as defined below.

Regarding zinc, the new 7xx aluminum casting alloys generally include from 3.0 to 8.0 wt. % Zn. In one embodiment, a new 7xx aluminum casting alloy includes not greater than 7.5 wt. % Zn. In another embodiment, a new 7xx aluminum casting alloy includes not greater than 7.0 wt. % Zn. In yet another embodiment, a new 7xx aluminum casting alloy includes not greater than 6.5 wt. % Zn. In another embodiment, a new 7xx aluminum casting alloy includes not greater than 6.0 wt. % Zn. In yet another embodiment, a new 7xx aluminum casting alloy includes not greater than 5.5 wt. % Zn. In another embodiment, a new 7xx aluminum casting alloy includes not greater than 5.0 wt. % Zn. In one embodiment, a new 7xx aluminum casting alloy includes at least 3.25 wt. % Zn. In another embodiment, a new 7xx aluminum casting alloy includes at least 3.5 wt. % Zn. In yet another embodiment, a new 7xx aluminum casting alloy includes at least 3.75 wt. % Zn. In another embodiment, a new 7xx aluminum casting alloy includes at least 4.0 wt. % Zn.

The new 7xx aluminum casting alloys generally include magnesium in the range of from 1.0 to 3.0 wt. % Mg. The amount of zinc exceeds the amount of magnesium. In one embodiment, a new 7xx aluminum casting alloy includes not greater than 2.75 wt. % Mg. In another embodiment, a new 7xx aluminum casting alloy includes not greater than 2.5 wt. % Mg. In yet another embodiment, a new 7xx aluminum casting alloy includes not greater than 2.25 wt. % Mg. In another embodiment, a new 7xx aluminum casting alloy includes not greater than 2.0 wt. % Mg. In yet another embodiment, a new 7xx aluminum casting alloy includes not greater than 1.8 wt. % Mg. In one embodiment, a new 7xx aluminum casting alloy includes at least 1.1 wt. % Mg. In another embodiment, a new 7xx aluminum casting alloy includes at least 1.2 wt. % Mg. In yet another embodiment, a new 7xx aluminum casting alloy includes at least 1.3 wt. % Mg. In another embodiment, a new 7xx aluminum casting alloy includes at least 1.4 wt. % Mg.

The new 7xx aluminum casting alloys generally include copper and in the range of from 0.35 to 1.0 wt. % Cu. The amount of magnesium exceeds the amount of copper. As shown below, copper may facilitate, for example, improved corrosion resistance and/or strength. In one embodiment, a new 7xx aluminum casting alloy includes not greater than 0.95 wt. % Cu. In another embodiment, a new 7xx aluminum casting alloy includes not greater than 0.90 wt. % Cu. In yet another embodiment, a new 7xx aluminum casting alloy includes not greater than 0.85 wt. % Cu. In another embodiment, a new 7xx aluminum casting alloy includes not greater than 0.80 wt. % Cu. In one embodiment, a new 7xx aluminum casting alloy includes at least 0.40 wt. % Cu. In another embodiment, a new 7xx aluminum casting alloy includes at least 0.45 wt. % Cu. In yet another embodiment, a new 7xx aluminum casting alloy includes at least 0.50 wt. % Cu. In another embodiment, a new 7xx aluminum casting alloy includes at least 0.55 wt. % Cu. In yet another embodiment, a new 7xx aluminum casting alloy includes at least 0.60 wt. % Cu.

The new 7xx aluminum casting alloys generally include from 0.05 to 0.30 wt. % V. As shown below, vanadium may facilitate, for example, improved corrosion resistance. In one embodiment, a new 7xx aluminum casting alloy includes not greater than 0.25 wt. % V. In another embodiment, a new 7xx aluminum casting alloy includes not greater than 0.20 wt. % V. In yet another embodiment, a new 7xx aluminum casting alloy includes not greater than 0.18 wt. % V. In another embodiment, a new 7xx aluminum casting alloy includes not greater than 0.16 wt. % V. In yet another embodiment, a new 7xx aluminum casting alloy includes not greater than 0.15 wt. % V. In another embodiment, a new 7xx aluminum casting alloy includes not greater than 0.14 wt. % V. In yet another embodiment, a new 7xx aluminum casting alloy includes not greater than 0.13 wt. % V. In another embodiment, a new 7xx aluminum casting alloy includes not greater than 0.12 wt. % V. In yet another embodiment, a new 7xx aluminum casting alloy includes not greater than 0.11 wt. % V. In one embodiment, a new 7xx aluminum casting alloy includes at least 0.06 wt. % V. In another embodiment, a new 7xx aluminum casting alloy includes at least 0.07 wt. % V. In yet another embodiment, a new 7xx aluminum casting alloy includes at least 0.08 wt. % V. In another embodiment, a new 7xx aluminum casting alloy includes at least 0.09 wt. % V. Not greater than 0.15 wt. % V should be used when fatigue properties are important.

The new 7xx aluminum casting alloys generally include from 0.01 to 1.0 wt. % (in total) of one or more secondary elements, wherein the secondary elements are selected from the group consisting of manganese, zirconium, chromium, titanium, boron and combinations thereof. Such secondary elements may at least partially assist, for example, with achieving the appropriate grain structure and size. In one embodiment, the new 7xx aluminum casting alloys include 0.10 to 0.80 wt. % (in total) of the secondary elements. In another embodiment, the new 7xx aluminum casting alloys include 0.15 to 0.60 wt. % (in total) of the secondary elements. In another embodiment, the new 7xx aluminum casting alloys include 0.15 to 0.45 wt. % (in total) of the secondary elements. The one or more secondary elements may be included in the 7xx aluminum casting alloy, and in any combination that facilitates the appropriate grain size and structure, so long as the total amount of the secondary elements falls within the scope of the ranges provided above. In one embodiment, the secondary elements at least include zirconium. In another embodiment, the secondary elements at least include zirconium and titanium. In yet another embodiment, the secondary elements at least include zirconium, titanium, and boron. In yet another embodiment, the secondary elements at least include zirconium, manganese, titanium, and boron. In some of these embodiments, the 7xx aluminum casting alloy is substantially free of chromium, as defined below. In another embodiment, the secondary elements include all of zirconium, manganese, titanium, chromium and boron. In other embodiments, the 7xx aluminum casting alloy at least includes chromium, but is substantially free of one or more of manganese, zirconium, titanium, and boron, as defined below.

In embodiments where manganese is present, the new 7xx aluminum casting alloys generally include from 0.01 to 0.50 wt. % Mn. In one embodiment, a new 7xx aluminum casting alloy includes from 0.01 to 0.25 wt. % Mn. In another embodiment, a new 7xx aluminum casting alloy includes from 0.01 to 0.15 wt. % Mn. In yet another embodiment, a new 7xx aluminum casting alloy includes from 0.01 to 0.10 wt. % Mn. In another embodiment, a new 7xx aluminum casting alloy includes from 0.01 to 0.09 wt. % Mn. In yet another embodiment, a new 7xx aluminum casting alloy includes from 0.01 to 0.08 wt. % Mn. In yet another embodiment, a new 7xx aluminum casting alloy includes from 0.01 to 0.07 wt. % Mn. In some embodiments, the new 7xx aluminum casting alloys are substantially free of manganese, and, in these embodiments, contain less than 0.01 wt. %. Mn.

In embodiments where zirconium is present, the new 7xx aluminum casting alloys generally include from 0.05 to 0.25 wt. % Zr. In one embodiment, a new 7xx aluminum casting alloy includes from 0.05 to 0.20 wt. % Zr. In another embodiment, a new 7xx aluminum casting alloy includes from 0.07 to 0.18 wt. % Zr. In some embodiments, the new 7xx aluminum casting alloys are substantially free of zirconium, and, in these embodiments, contain less than 0.05 wt. %. Zr, such as less than 0.03 wt. % Zr, or less than 0.01 wt. % Zr.

In embodiments where chromium is present, the new 7xx aluminum casting alloys generally include from 0.05 to 0.40 wt. % Cr. In one embodiment, a new 7xx aluminum casting alloy includes from 0.10 to 0.35 wt. % Cr. In another embodiment, a new 7xx aluminum casting alloy includes from 0.15 to 0.25 wt. % Cr. In some embodiments, the new 7xx aluminum casting alloys are substantially free of chromium, and, in these embodiments, contain less than 0.05 wt. %. Cr, such as less than 0.03 wt. % Cr, or less than 0.01 wt. % Cr.

In embodiments where titanium is present, the new 7xx aluminum casting alloys generally include from 0.01 to 0.25 wt. % Ti. In one embodiment, a new 7xx aluminum casting alloy includes from 0.01 to 0.15 wt. % Ti. In another embodiment, a new 7xx aluminum casting alloy includes from 0.01 to 0.10 wt. % Ti. In yet another embodiment, a new 7xx aluminum casting alloy includes from 0.01 to 0.08 wt. % Ti. In another embodiment, a new 7xx aluminum casting alloy includes from 0.02 to 0.07 wt. % Ti. In some embodiments, the new 7xx aluminum casting alloys are substantially free of titanium, and, in these embodiments, contain less than 0.01 wt. %. Ti, such as less than 0.005 wt. % Ti, or less than 0.001 wt. % Ti.

In embodiments where boron is present, the new 7xx aluminum casting alloys generally include from 0.001 to 0.050 wt. % B. In one embodiment, a new 7xx aluminum casting alloy includes from 0.005 to 0.040 wt. % B. In another embodiment, a new 7xx aluminum casting alloy includes from 0.010 to 0.030 wt. % B. In some embodiments, the new 7xx aluminum casting alloys are substantially free of boron, and, in these embodiments, contain less than 0.001 wt. %. Ti, such as less than 0.0005 wt. % B, or less than 0.0001 wt. % B.

The new 7xx casting alloys may include iron, up to 0.50 wt. % Fe, sometimes as an impurity. In one embodiment, a new 7xx aluminum casting alloy includes not greater than 0.35 wt. % Fe. In another embodiment, a new 7xx aluminum casting alloy includes not greater than 0.25 wt. % Fe. In yet another embodiment, a new 7xx aluminum casting alloy includes not greater than 0.15 wt. % Fe. In another embodiment, a new 7xx aluminum casting alloy includes not greater than 0.10 wt. % Fe. In one embodiment, a new 7xx aluminum casting alloy includes at least 0.01 wt. % Fe.

The new 7xx casting alloys may include silicon, up to 0.25 wt. % Si, sometimes as an impurity. In one embodiment, a new 7xx casting alloy includes not greater than 0.20 wt. % Si. In another embodiment, a new 7xx casting alloy includes not greater than 0.15 wt. % Si. In yet another embodiment, a new 7xx casting alloy includes not greater than 0.10 wt. % Si. In another embodiment, a new 7xx casting alloy includes not greater than 0.05 wt. % Si. In one embodiment, a new 7xx aluminum casting alloy includes at least 0.01 wt. % Si.

The new 7xx aluminum casting alloy may be substantially free of other elements. As used herein, "other elements" means any other elements of the periodic table other than the above-listed zinc, magnesium, copper, vanadium, manganese, zirconium, chromium, titanium, boron, iron, and silicon, as described above. In the context of this paragraph, the phrase "substantially free" means that the new 7xx aluminum casting alloys contain not more than 0.10 wt. % each of any element of the other elements, with the total combined amount of these other elements not exceeding 0.35 wt. % in the new 7xx aluminum casting alloys. In another embodiment, each one of these other elements, individually, does not exceed 0.05 wt. % in the new 7xx aluminum casting alloys, and the total combined amount of these other elements does not exceed 0.15 wt. % in the new 7xx aluminum casting alloys. In another embodiment, each one of these other elements, individually, does not exceed 0.03 wt. % in the new 7xx aluminum casting alloys, and the total combined amount of these other elements does not exceed 0.10 wt. % in the new 7xx aluminum casting alloys.

In one embodiment, the new 7xx aluminum casting alloy is cast into a 7xx shape-cast part. In this regard, the casting step may be low pressure die casting, gravity permanent mold, semi-permanent mold, squeeze, casting, sand mold casting and spin/centrifugal casting. After the casting, the 7xx casting alloy may be tempered, such as by solution heat treating, and then quenching, and then natural or artificially aging. Suitable tempers include the T4, T5, T6, and T7 tempers, for instance.

The 7xx shape-cast part may be used in any suitable application, such as in any of an automotive, aerospace, industrial or commercial transportation application, among others. In one embodiment, the 7xx shape-cast part is an automotive part (e.g., a body-in-white (BIW) part; a suspension part). In one embodiment, the 7xx shape-cast part is included in an automobile. In one embodiment, the 7xx shape-cast part is an aerospace part. In one embodiment, the 7xx shape-cast part is included in an aerospace vehicle. In one embodiment, the 7xx shape-cast part is an industrial part. In one embodiment, the 7xx shape-cast part is a commercial transportation part. In one embodiment, the 7xx shape-cast part is included in a commercial transportation vehicle.

Although the new 7xx alloys have been described as shape-casting alloys, it is anticipated that the alloy compositions described herein may also be useful in producing wrought products. For instance, the alloys described herein may be cast (e.g., as ingot or billet), then homogenized, and then hot worked to an intermediate or final form (e.g., cold working after the hot working when the hot working produces an intermediate form). In one embodiment, the hot working is forging. In one embodiment, the forging produces a shaped product, such as a wheel product. In another embodiment, the hot working is rolling or extruding. After the hot working (and any optional cold working), the new alloy may be tempered, such as by solution heat treating, and then quenching, and then natural or artificially aging. Suitable tempers include the T4, T5, T6, and T7 tempers, for instance. In one embodiment, the new alloy compositions described herein are processed into a forged wheel product per the processes described in commonly-owned U.S. Patent Application Publication No. 2006/0000094, which is incorporated herein by reference in its entirety.

DETAILED DESCRIPTION

Example 1

Several 7xx aluminum casting alloys having the compositions shown in Table 1, below, were cast via directional solidification. The dimensions of the directionally solidified alloys were approximately 25.4 mm (1 inch) thick, 102 mm (4 inches) wide, and 254 mm (10 inches) long.

TABLE 1

Composition of Example 1 Alloys (in wt. %)

| | Actual Composition, wt. % | | | | | | | | | |
|---|---|---|---|---|---|---|---|---|---|---|
| Alloy | Zn | Mg | Cu | Fe | Si | Mn | Ti | V | Zr | B |
| A1 | 4.21 | 1.55 | 0.65 | 0.08 | 0.05 | 0.05 | 0.07 | 0.009 | 0.09 | 0.02 |
| A2 | 4.20 | 1.56 | 0.65 | 0.08 | 0.05 | 0.05 | 0.07 | 0.057 | 0.09 | 0.02 |
| A3 | 4.35 | 1.62 | 0.63 | 0.08 | 0.05 | 0.05 | 0.06 | 0.103 | 0.09 | 0.02 |
| A4 | 4.33 | 1.63 | 0.63 | 0.08 | 0.05 | 0.05 | 0.07 | 0.151 | 0.09 | 0.02 |

Alloys A2-A4 are invention alloys.

After casting, the alloys were solution heated by heating from room temperature to about 515.6° C. (960° F.), in about 2 hours, holding at about 515.6° C. (960° F.) for 6 hours, and then quenching in boiling water. The alloys were then naturally aged for about 12-24 hours, and then artificially aged by heating to about 204° C. (400° F.) in about 50 minutes, holding at about 204° C. (400° F.) for about 10 minutes, cooling to 182° C. (360° F.) in about 15 minutes, holding at 182° C. (360° F.) for about 4 hours, and then air cooling to room temperature.

The Stress corrosion cracking (SCC) resistance of the alloys was then in accordance with ASTM G103-97(2011), the "Standard Practice for Evaluating Stress-Corrosion Cracking Resistance of Low Copper 7XXX Series Al—Zn—Mg—Cu Alloys in Boiling 6% Sodium Chloride Solution". A stress level of 240 MPa was used for all specimens evaluated. Five replicated SCC specimens were used for each alloy. The SCC results are shown in Table 2, below.

TABLE 2

SCC boiling salt test results of Example 1 Alloys

| Alloy | Days to Failure | | | | |
|---|---|---|---|---|---|
| A1 | 10 | OK 14 | 2.91 | OK 14 | 5.9 |
| A2 | 7.23 | OK 14 | OK 14 | 12.02 | OK 14 |
| A3 | OK 14 | OK 14 | OK 14 | OK 14 | OK 14 |
| A4 | OK 14 | OK 14 | OK 14 | OK 14 | OK 14 |

"OK 14"=passed 14 days of testing without failure.

The addition of vanadium improves the SCC performance of the Al—Zn—Mg—Cu alloys. Two specimens of alloy A1 failed within one week in boiling salt tests, whereas the specimens of vanadium-containing alloys passed 1-week boiling salt tests without failure. Larger vanadium content leads to improved SCC performance. Two SCC specimens of alloy A2 (0.057 wt. % V) failed in between one to two weeks, while specimens of A3 (0.103 wt. % V) and A4 (0.151 wt. % V) passed two weeks without any failures.

The mechanical properties of the alloys were also tested in accordance with ASMT B557 and E8, the results of which are shown in Table 3, below. Adding vanadium did not materially impact tensile or yield strength, but did decrease elongation slightly.

TABLE 3

Mechanical Properties of Example 1 Alloys

| Alloy | Yield Strength, MPa | Tensile Strength, MPa | Elongation, % |
|---|---|---|---|
| A1 | 320.8 | 376.0 | 11.0 |
| A2 | 305.9 | 365.4 | 10.3 |

TABLE 3-continued

Mechanical Properties of Example 1 Alloys

| Alloy | Yield Strength, MPa | Tensile Strength, MPa | Elongation, % |
|---|---|---|---|
| A3 | 323.4 | 376.9 | 9.0 |
| A4 | 321.3 | 375.0 | 9.0 |

Example 2

Several 7xx aluminum casting alloys having the compositions shown in Table 4, below, were prepared as per Example 1. SCC and mechanical properties were again measured using the same ASTM tests and conditions used in Example 1, the results of which are shown in Tables 5-6, below.

TABLE 4

| Composition of Example 2 Alloys (in wt. %) | | | | | | | | | | |
|---|---|---|---|---|---|---|---|---|---|---|
| | Actual composition, wt. % | | | | | | | | | |
| Alloy | Zn | Mg | Cu | Fe | Si | Mn | Ti | V | Zr | B |
| B1 | 4.39 | 1.61 | — | 0.10 | 0.05 | 0.05 | 0.07 | 0.11 | 0.093 | 0.02 |
| B2 | 4.38 | 1.61 | 0.25 | 0.10 | 0.05 | 0.05 | 0.07 | 0.11 | 0.093 | 0.02 |
| B3 | 4.38 | 1.62 | 0.48 | 0.10 | 0.05 | 0.05 | 0.07 | 0.10 | 0.091 | 0.02 |
| B4 | 4.39 | 1.61 | 0.78 | 0.10 | 0.05 | 0.05 | 0.07 | 0.11 | 0.091 | 0.02 |

Alloys B3 and B4 are invention alloys.

TABLE 5

| SCC boiling salt test results for Example 2 Alloys | | | | | |
|---|---|---|---|---|---|
| Alloy | Days to Failure | | | | |
| B1 | 0.08 | 0.08 | 0.08 | 0.08 | 0.08 |
| B2 | 0.08 | 0.75 | 3.74 | 0.75 | 0.92 |
| B3 | OK7 | OK7 | OK7 | OK7 | OK7 |
| B4 | OK7 | OK7 | OK7 | 5.77 | OK7 |

"OK 7"=passed 7 days of testing without failure.

TABLE 6

| Mechanical Properties of Example 2 Alloys | | | |
|---|---|---|---|
| Alloy | Yield Strength, MPA | Tensile Strength, MPA | Elongation, % |
| B1 | 268.5 | 323.0 | 12.0 |
| B2 | 284.5 | 338.8 | 10.3 |
| B3 | 301.5 | 353.8 | 8.7 |
| B4 | 323.0 | 367.2 | 6.7 |

As shown in Table 5, copper had a significant impact on SCC performance. All specimens of the alloy without copper (B1) failed in less than 2 hours (0.08 days). All specimens of the alloy with 0.48 wt. % Cu (B3) passed 7 days of testing at a stress level of 240 MPa. As shown in Table 6, increasing copper generally increases strength, but decreases elongation.

While various embodiments of the present disclosure have been described in detail, it is apparent that modifications and adaptations of those embodiments will occur to those skilled in the art. However, it is to be expressly understood that such modifications and adaptations are within the spirit and scope of the present disclosure.

What is claimed is:

1. A shape-cast aluminum alloy part consisting of:

(a) from 4.0 to 5.5 wt. % Zn;

(b) from 1.0 to 2.0 wt. % Mg;

(c) from 0.35 to 1.0 wt. % Cu;

wherein the wt. % Mg exceeds the wt. % Cu;

(d) from 0.05 to 0.30 wt. % V;

(e) from 0.01 to 1.0 wt. % of at least one secondary element, wherein the at least one secondary element is selected from the group consisting of Mn, Cr, Zr, Ti, B, and combinations thereof;

wherein, when present, the shape-cast aluminum alloy part includes not greater than 0.50 wt. % Mn as a secondary element;

wherein, when present, the shape-cast aluminum alloy part includes not greater than 0.40 wt. % Cr as a secondary element;

wherein, when present, the shape-cast aluminum alloy part includes not greater than 0.25 wt. % Zr as a secondary element;

wherein, when present, the shape-cast aluminum alloy part includes not greater than 0.25 wt. % Ti as a secondary element;

wherein, when present, the shape-cast aluminum alloy part includes not greater than 0.05 wt. % B as a secondary element;

(f) up to 0.15 wt. % Fe (g) up to 0.15 wt. % Si; and (h) the balance being aluminum and other elements, wherein the shape-cast aluminum alloy part includes not greater than 0.03 wt. % each of the other elements, and wherein the shape-cast aluminum alloy part includes not greater than 0.10 wt. % in total of the other elements;

wherein the shape-cast aluminum alloy part is produced by low pressure die casting, gravity permanent mold casting, semi-permanent mold casting, sand mold casting, or spin/centrifugal casting;

wherein the shape-cast aluminum alloy part is a body-in-white or suspension part;

wherein the shape-cast aluminum alloy part realizes a tensile yield strength of not greater than 330 MPa; and wherein the shape-cast aluminum alloy part passes SCC testing in accordance with ASTM G103-97 (2011), wherein the SCC testing is conducted at a net stress of 240 MPa, wherein 5 specimens are tested, and wherein all of the 5 specimens did not fail under the standard ASTMG103-97 (2011) for at least 14 days.

2. The shape-cast aluminum alloy part of claim 1, wherein the shape-cast aluminum alloy part includes not greater than 1.8 wt. % Mg.

3. The shape-cast aluminum alloy part of claim 1, wherein the shape-cast aluminum alloy part includes at least 1.1 wt. % Mg.

4. The shape-cast aluminum alloy part of claim 1, wherein the shape-cast aluminum alloy part includes at least 1.2 wt. % Mg.

5. The shape-cast aluminum alloy part of claim 1, wherein the shape-cast aluminum alloy part includes at least 1.3 wt. % Mg.

6. The shape-cast aluminum alloy part of claim 2, wherein the shape-cast aluminum alloy part includes at least 1.4 wt. % Mg.

7. The shape-cast aluminum alloy part of claim 1, wherein the shape-cast aluminum alloy part includes not greater than 0.25 wt. % V.

8. The shape-cast aluminum alloy part of claim 1, wherein the shape-cast aluminum alloy part includes not greater than 0.20 wt. % V.

9. The shape-cast aluminum alloy part of claim 1, wherein the shape-cast aluminum alloy part includes not greater than 0.18 wt. % V.

10. The shape-cast aluminum alloy part of claim 1, wherein the shape-cast aluminum alloy part includes not greater than 0.16 wt. % V.

11. The shape-cast aluminum alloy part of claim 6, wherein the shape-cast aluminum alloy part includes not greater than 0.14 wt. % V.

12. The shape-cast aluminum alloy part of claim 1, wherein the shape-cast aluminum alloy part includes at least 0.06 wt. % V.

13. The shape-cast aluminum alloy part of claim 1, wherein the shape-cast aluminum alloy part includes at least 0.07 wt. % V.

14. The shape-cast aluminum alloy part of claim 1, wherein the shape-cast aluminum alloy part includes at least 0.08 wt. % V.

15. The shape-cast aluminum alloy part of claim 11, wherein the shape-cast aluminum alloy part includes at least 0.09 wt. % V.

16. The shape-cast aluminum alloy part of claim 1, wherein the shape-cast aluminum alloy part includes not greater than 0.95 wt. % Cu.

17. The shape-cast aluminum alloy part of claim 1, wherein the shape-cast aluminum alloy part includes not greater than 0.80 wt. % Cu.

18. The shape-cast aluminum alloy part of claim 17, wherein the shape-cast aluminum alloy part includes at least 0.40 wt. % Cu.

19. The shape-cast aluminum alloy part of claim 17, wherein the shape-cast aluminum alloy part includes at least 0.50 wt. % Cu.

* * * * *